United States Patent [19]

Clark

[11] Patent Number: 4,656,792

[45] Date of Patent: Apr. 14, 1987

[54] TRUSS BUILDING SYSTEM

[76] Inventor: Gerald L. Clark, 1740 E. Butler, Phoenix, Ariz. 85020

[21] Appl. No.: 587,304

[22] Filed: Mar. 7, 1984

[51] Int. Cl.[4] ..... E04B 7/02

[52] U.S. Cl. ..... 52/93; 52/642; 52/643

[58] Field of Search ..... 52/643, 745, 639, 93, 52/92, 90, 126.3, 122.1, 642, 693, 36

[56] References Cited

U.S. PATENT DOCUMENTS

| | | | |
|---|---|---|---|
| 1,703,511 | 2/1929 | Copeman | 52/36 |
| 1,735,931 | 11/1929 | Nardon | 52/36 |
| 1,753,862 | 4/1930 | Johnson | 52/642 |
| 2,288,193 | 6/1942 | Horn et al. | 52/642 |
| 2,390,180 | 12/1945 | Sahlberg | 52/93 |
| 2,904,139 | 9/1959 | Prudhon | 52/90 |
| 3,039,152 | 6/1962 | Hillesheim | 52/642 |
| 3,156,018 | 11/1964 | Slayter | 52/643 |
| 3,263,381 | 8/1966 | Dickinson | 52/90 |
| 4,030,256 | 6/1977 | Ollman | 52/643 |
| 4,201,021 | 5/1980 | Aldag et al. | 52/639 |
| 4,483,117 | 11/1984 | Underhill et al. | 52/639 |

FOREIGN PATENT DOCUMENTS

| | | | |
|---|---|---|---|
| 1128114 | 4/1962 | Fed. Rep. of Germany | 52/745 |
| 761 | of 1903 | United Kingdom | 52/693 |
| 89 | of 1913 | United Kingdom | 52/642 |

*Primary Examiner*—Henry E. Raduazo

*Attorney, Agent, or Firm*—LaValle D. Ptak

[57] ABSTRACT

A building system utilizes a combined roof/wall truss construction where each truss is made in a single U-shaped unit having spaced-apart wall truss subsystems interconnected with a roof truss subsystem. The trusses then are set up with the lowermost ends of the wall trusses resting on and attached to the foundation or building floor slab. The trusses are spaced apart at 32" intervals and are held in a vertical orientation by means of standard sheathing for the walls and roof. Window and door openings are formed in the spaces between the adjacent wall truss subsystems, and the depth of the wall truss subsystems is selected to provide space for built-in cabinets, closets, and unique window treatments.

6 Claims, 5 Drawing Figures

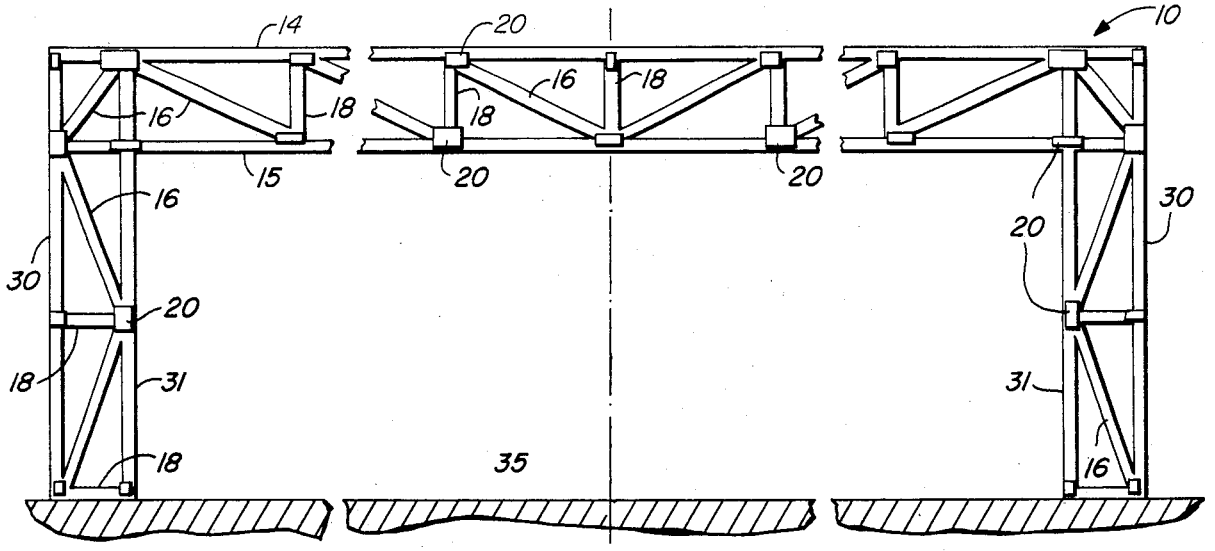
FIG. 1
FIG. 2
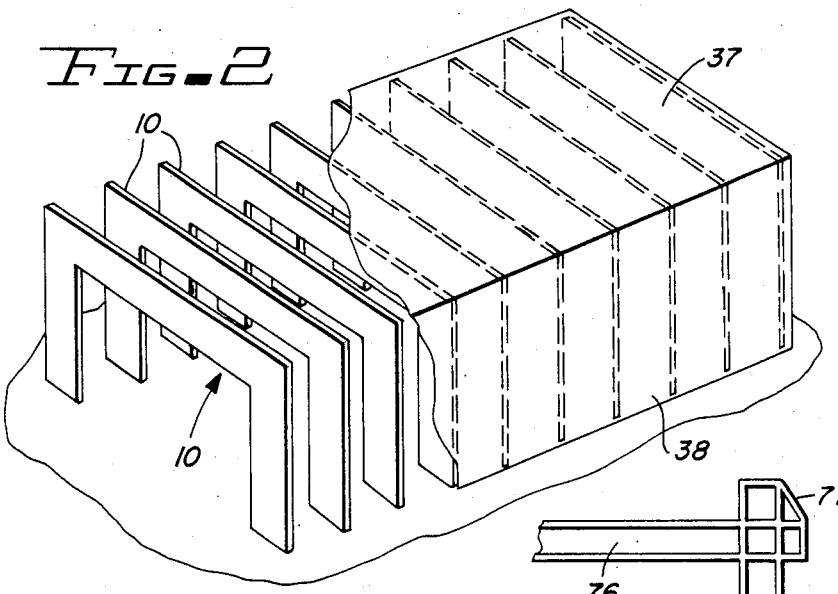
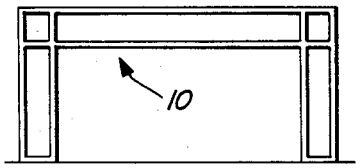
FIG. 3A
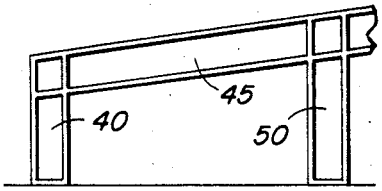
FIG. 3B
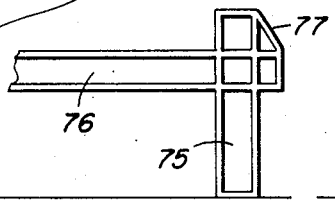
FIG. 3G
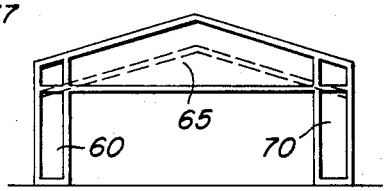
FIG. 3C
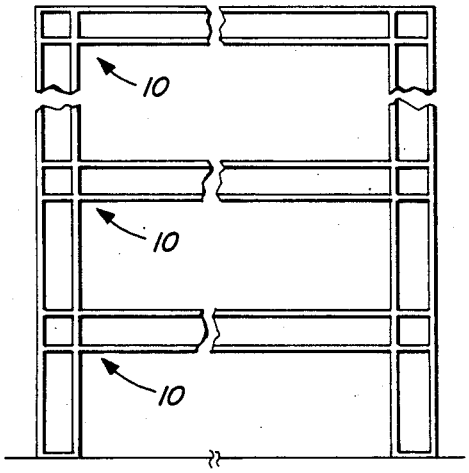
FIG. 3F
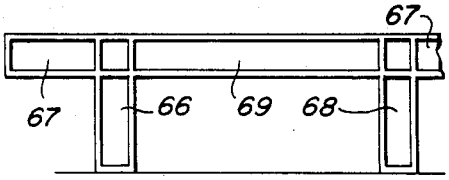
FIG. 3D
FIG. 3E
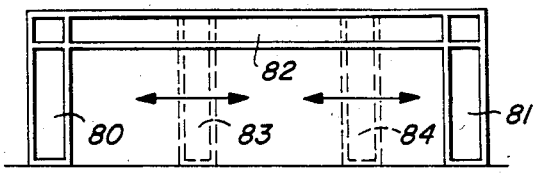

FIG. 4
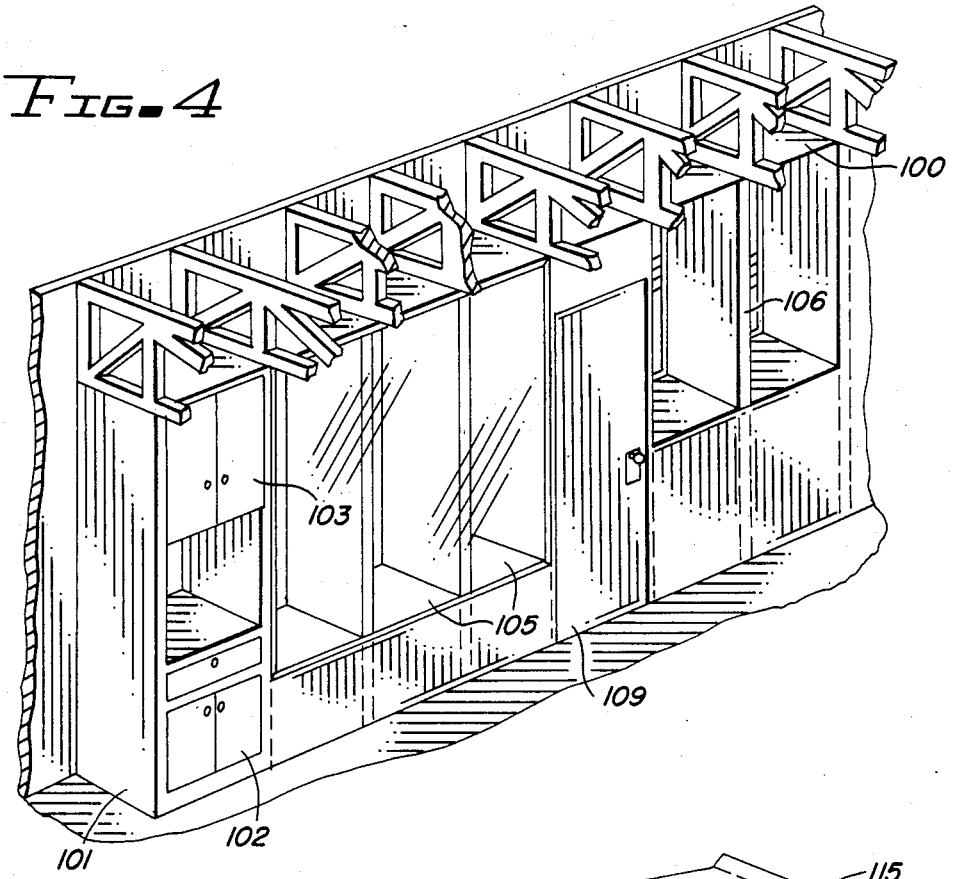
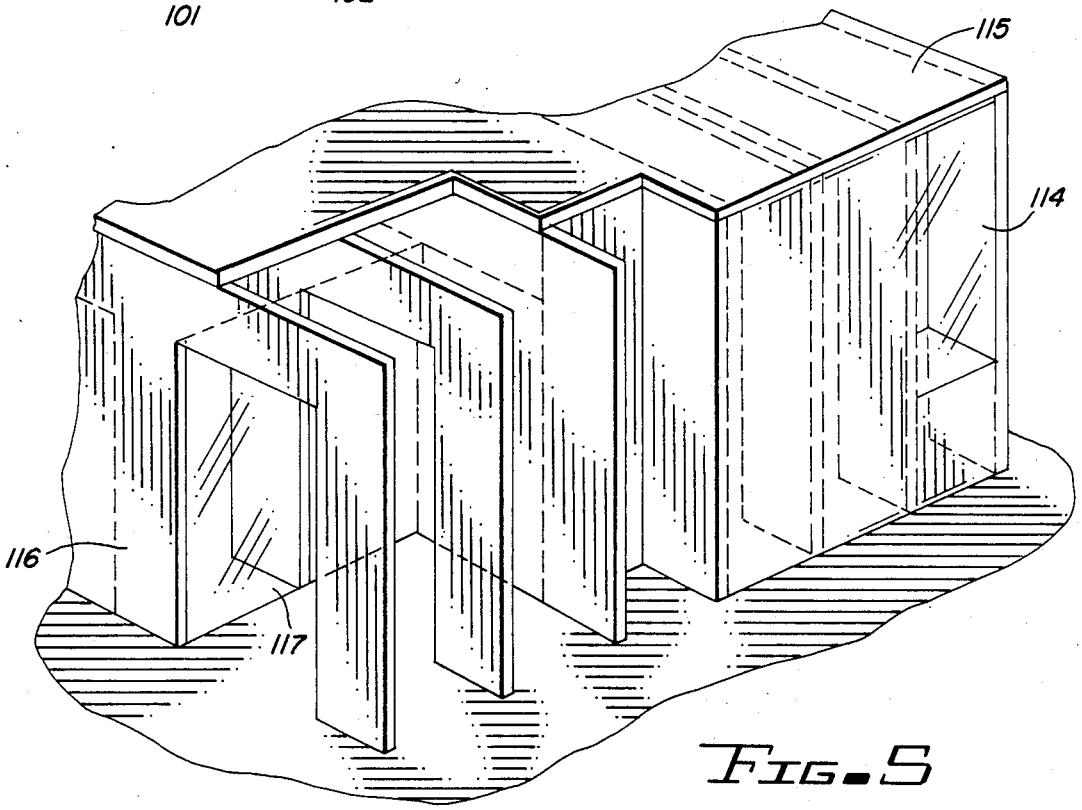
FIG. 5

TRUSS BUILDING SYSTEM

BACKGROUND OF THE INVENTION

A variety of different building techniques and materials are employed for the construction of residential and commercial small building types. A majority of these buildings, however, are constructed by means of light frame wood construction. Conventional light frame construction involves piece-by-piece on-site cutting, fitting, and assembly of the different parts of the building comprising the exterior and interior walls, ceiling and roof members. This is a labor-intensive operation which requires a high degree of carpentry skills. It is necessary to coordinate the carpentry work with that of other trades such as plumbing, heating and electrical, on a relatively precise and critical time schedule. Because so much work must be done on a piece-by-piece basis at the site, a considerable time lapse occurs between the start of the work and the point where the house or building finally is enclosed and is relatively immune from wind and rain during the remainder of the construction of the interior. In such conventional frame construction, holes must be cut or drilled in the framing for electric lines, plumbing pipes and some duct work. All of this is time consuming and expensive, and adds considerably to the completed cost of the building.

In efforts to reduce the amount of building time on the site of construction, and further, to provide a less expensive but structurally stronger building, proposals have been made for what may be termed "truss-frame" houses. Such a construction technique is disclosed in the patent to Roger L. Tuomi, U.S. Pat. No. 4,005,556. The structure of this patent consists of a plurality of flat structural building frames, each comprising a roof truss system and a floor truss system interconnected at opposite ends to one another through conventional wall studs. The floor truss system is necessary to provide structural rigidity to the overall unit, so that the resultant frame comprises a completely enclosed outline of the building envelope ultimately to be enclosed by it. These frames then are set up side by side on the building foundation and are interconnected to give them vertical stability. The siding, flooring and roof sheathing is attached to the frames in a conventional manner. The use of the structures disclosed in the Tuomi patent considerably reduces the time required to erect and enclose a house or other building. The floor truss arrangement and the roof truss system both provide spaces for the major plumbing, electrical and ductwork required in the building. It still is necessary, however, to drill or cut holes in the studs forming the exterior walls to accomodate electrical lines, plumbing and the like in these walls. In addition, it should be noted that the structure of the Tuomi patent is not suited for houses of the type constructed on poured concrete slabs which do not have basements or crawl spaces beneath the main floor. Such construction, however, is widely used, particularly in the southern and western parts of the United Stats. Consequently, the Tuomi interconnected roof truss/floor truss system does not have utility where slab floor construction is desired.

Another system using components which are similar to the ones used in the Tuomi patent is disclosed in the patent to Slayter, U.S. Pat. No. 3,156,018. The Slayter patent is directed to a plant-manufactured building structure or a prefabricated complete building structure. Subcomponents of this building structure include roof and floor truss subsystems which are interconnected by a sidewall system of a generally triangular configuration. This produces outwardly sloped exterior sidewalls with a vertical inside sidewall surface. The Slater system requires a complete surrounding truss subsystem including floor, roof and the interconnecting sidewall system. These are all incorporated together into a prefabricated building which subsequently is moved from the manufacturing site to the site where it is to be erected.

In the construction of commercial building using metal or steel truss systems and reinforced steel sidewall systems, various attempts have been made to prefabricate subsystems for subsequent interconnection and erection at the building site. One such system is shown in the patent to Ollman, U.S. Pat. No. 4,030,256. This patent discloses the use of a steel roof and ceiling system using prefabricated roof and ceiling truss frames. Each of these has downwardly depending vertical legs at the corners which then subsequently are connected to sidewall steel frame subsections to construct a completed building. Thus, separate matching sections must be aligned and interconnected at the building site in order to produce the frame for the building constructed in accordance with the building construction system disclosed in the Ollman patent.

Other patents have disclosed building subsystems utilizing metal or wooden trusses formed in generally L-shaped configurations to produce wall and roof subsections, two of which are interconnected together at the building site at the apex of the roof sections to form the frame for enclosing the building. These systems generally are used for warehouses and the like, and the nature of the trusses generally is in the form of triangular legs of non-uniform depth which precludes their use in most homes and small office buildings. In addition, it still is necessary in the construction of buildings using such systems to cut or drill holes for plumbing, electrical lines or ductwork necessary for the completed building structure. Three patents which disclose systems of this type are the patents to Prudhon, U.S. Pat. No. 2,904,139; Sahlberg, U.S. Pat. No. 2,390,180; and Dickinson, U.S. Pat. No. 3,263,381.

Various other preassembled building structures have been attempted in the past, but all are subject to one or more shortcomings present in the structures discussed above. Generally, these subsystems are not such as to substantially minimize the construction work required at the building site. Most of them do not facilitate the installation of wiring, heating and plumbing lines, but generally are subject to the same disadvantages encountered in conventional on-site frame construction of buildings.

Accordingly, it is an object of this invention to provide an improved building system which is capable of reducing the cost of the completed building, simplifies the construction, and provides a variety of possibilities for architectural variations from both aesthetic and practical considerations resulting directly from the building subsystem itself.

SUMMARY OF THE INVENTION

Accordingly, it is an object of this invention to provide an improved building system.

It is another object of this invention to provide an improved building truss system.

It is an additional object of this invention to provide a unitary building truss subsystem incorporating wall and roof truss subsystems for use as a modular building component.

It is a further object of this invention to provide an improved building frame unit which facilitates construction of a building and reduces the time and cost of such construction.

Accordingly, a preferred embodiment of this invention comprises a roof truss subsystem which includes top and bottom chord members, spaced apart and interconnected by a plurality of reinforcing web brace members. Connected to opposite ends of this roof truss subsystem are first and second wall truss subsystems, each comprising interior and exterior chord members spaced apart from one another and interconnected by a plurality of reinforcing web brace members. The resultant is a flat unitary substantially U-shaped building frame unit which is used in conjunction with other similar frame units as the primary structural subsystem for the building. These units are interconnected by roof and wall sheathing to form the completed building structure.

BRIEF DESCRIPTION OF THE DRAWINGS

FIG. 1 is a partially broken-away plan view of a preferred embodiment of the invention;

FIG. 2 is an illustration of the manner in which a number of the units shown in FIG. 1 may be erected to form the supporting frame for a building structure;

FIGS. 3A through 3F are diagrammatic illustrations of different forms which may be taken by a building truss system of the type shown in FIG. 1;

FIG. 4 illustrate different architectural treatments which may be accomplished on the interior of a building constructed utilizing the truss building system shown in FIGS. 1 and 2; and FIG. 5 illustrates exterior architectural details which may be accomplished by using the building truss system of the preferred embodiment of this invention.

DETAILED DESCRIPTION

Reference now should be made to the drawings in which the same reference numbers are used in the different figures to designate the same or similar components.

The basic structural technique which is used in accordance with the building system shown in the drawings is that of incorporating the use of prefabricated or off-site constructed, generally U-shaped, truss subsystems. For some time, it has been relatively common practice to construct roof and ceiling truss systems which are erected onto the top of otherwise conventionally constructed building walls in the fabrication of a building at a a building site. These roof trusses may take on a variety of configurations, depending upon the particular type of roof desired. These may range from flat-roofed buildings to pitched roofs of a variety of different configurations. In the system shown in the drawings, with particular attention being directed to FIG. 1, the truss concept has been expanded considerably to combined a roof truss with the outside or major support walls of the building into a single piece, generally U-shaped truss.

The entire subassembly may be manufactured in a single integrated unit in a truss factory utilizing jigs of types commonly used in such industry. The various unitary truss subassemblies then are transported to the building site and erected on-site to form the building frame. A typical truss 10 for a flat-roofed building is shown in FIG. 1. This truss includes a roof truss subassembly incorporating a top chord 14 and a bottom chord 15. These chords 14 and 15 are interconnected by diagonal and vertical bracing webs 16 and 18, respectively, to provide structural rigidity and strength to the overall structure.

The webs 16 and 18 are interconnected to the top and bottom roof chords 14 and 15 by means of conventional metal truss plates 20, plywood gusset plates, or any rigid fasteners capable of transmitting moment, sheer and axial forces between the webs 16, 18 and the chords 14, 15. Also, as is well known, if the length of the span of the roof truss subsystem is greater than the normal length of available material, the chords 14 and 15 may be made by mechanically splicing shorter lengths of material without decreasing the strength of the frame. The splicing is done by means of metal truss plates, gusset plates, or other conventional interconnecting techniques.

To complete the truss system 10 shown in FIG. 1, a pair of wall truss subsystems extend downwardly from each of the ends of the roof truss subsystem. The wall truss subsystems each include an exterior chord 30 and an interior chord 31 interconnected by reinforcing diagonal and perpendicular web braces 16 and 18 similar to those used in the roof truss subsystem. As illustrated in FIG. 1, the two sidewall truss subsystems are identical to one another. If, for some reason, however, there is an interior step up from a high ceiling area to a lower ceiling area reflected in a variation in the floor elevation of the building, the side truss subsystems could be of different lengths. In most cases, however, the side truss subsystems illustrated in FIG. 1 on opposite ends of the roof truss subsystems will be of the same length.

The resultant truss system 10, which is prefabricated at a factory in a single piece, then is duplicated or repeated for each of the different areas to be enclosed at the building site. Different truss systems 10 having different spans, different vertical heights, and different roof lines may be incorporated into a single building in accordance with a plan which introduces a variety of different structural shapes into the building. The basic concept employed, however, is the same, irrespective of the specific truss dimensions.

At the building site, a foundatin or pre-poured floor 35 is finished prior to delivery of the truss systems 10 required for a particular building structure. The trusses 10 then are set up as shown in FIG. 1 and FIG. 2, with the lowermost ends of the wall truss subsystems resting on and attached to the foundation or building slab. This attachment may be made by any conventional means including, but not limited to, anchor straps, nailing, and anchor bolts embedded in the foundation or floor slab.

For spanning a particular area, the trusses are set up side by side, as illustrated in FIG. 2, and then are covered over on the top with conventional roof sheathing 37 and on the sides with side sheathing materials such as plywood sheets 38, plaster, pre-shaped foam insulating sheathing panels, or the like. This provides substantial structural rigidity to the building. In FIG. 2, door and window openings have not been shown, but may be provided between adjacent ones of the trusses 10, as desired.

Because interconnected wall/roof truss subsystems are used for the trusses 10, it is possible to use relatively lightweight materials, such as standard 2"×4" lumber or light steel channels, for all of the top and bottom roof chord members 14 and 15, as well as for the exterior and interior chord members 30 and 31, and the bracing webs 16 and 18. This, of course, does not preclude the use of heavier material where it is desired or necessary, but the result of the structure shown in FIGS. 1 and 2 permits the use of conventional 2"×4" lumber or light steel channels, to obtain a very strong frame suitable for most homes and small commercial building structures. Because of the strength which is a result of the trusses 10, it is not necessary to have the trusses as close together as conventional wall studs (typically, 16 inch spacing between studs); but a typical structure incorporates 32 inch spacing (residential) or 48 inch spacing (commercial) between each of the trusses 10. Thus, three successive truss assemblies 10 span a linear distance of 8 feet when they are erected as shown in FIG. 2, which permits conventional length sheathing and wallboard materials to be used in the building structure. This also causes the distance between adjacent trusses to be 32 inches (2 feet 8 inches) which is a very convenient width for windows, doors, cabinets and the like.

FIG. 3A is a diagrammatic representation of the truss system which is illustrated in FIGS. 1 and 2. The same techniques, however, may be used to obtain a variety of different building shapes and treatments. For example, in FIG. 3B, a sloped roof is obtained by utilizing a truss wall subsystem 40 on one end which is shorter than the truss wall subsystem 50 on the other end of the roof truss subsystem 45. The roof truss subsystem 45 also may extend beyond one or more of the wall truss subsystems 40 or 50.

In FIG. 3B, it is shown extending beyond or to the outside of the wall truss subsystem 50. FIG. 3C illustrates the manner in which a pair of equal height wall truss subsystems 60 and 70 are used in conjunction with a roof truss subsystem 65 to produce a gabled roof. This gabled roof may have either a flat ceiling, where the bottom roof chord is horizontal (shown in solid lines in FIG. 3C) or it may have a vaulted ceiling (as shown in dotted lines in FIG. 3C).

FIG. 3G illustrates the manner in which a mansard roof treatment may be obtained as an integral part of the interconnection of the wall truss subsystem 75 with a roof truss subsystem 76 by extending each beyond the other and interconnecting them with a mansard treatment subsystem 77.

FIG. 3D illustrates the manner in which a pair of equal height wall truss subsystems 66 and 68 are bridged and interconnected together with a roof truss subsystem 69 extending outwardly to the left and to the right to form overhangs 67 as an integral part of the unitary truss subsystem used to construct a building. The techniques for building and interconnecting the wall and roof truss subsystems of the configuration shown in FIG. 3D are precisely the same as described previously in conjunction with FIG. 1.

FIG. 3E illustrates the basic truss subsystem of FIG. 1 in which a pair of equal height wall truss subsystems 80 and 81 are used to interconnect a roof truss subsystem 82. An additional one or more wall truss subsystems 83 and 84 are illustrated located between the wall truss subsystems 80 and 81 to form interior walls or inset walls for use in patio treatment or the like. These additional wall truss subsystems 83 and 84 have been shown in dotted lines in FIG. 3E with arrows indicating that they may be located in any position desired by the architect or building designer.

It also should be noted that multi-story structures may be built, using the unitary trusses 10 of FIGS. 1 and 3A in particular, by simply stacking the trusses one on top of the other. In such an event, what has been called a roof truss subsystem in FIG. 1 for the lower or intermediate floors simply becomes a floor truss subsystem for the next higher floor, with the uppermost one of the units then comprising the roof truss subsystem which has been described previously. The structure, however, of each of the unitary trusses 10 shown in FIG. 3F to form a three-story building is the same as used for a single story building. Each floor is interconnected to the one immediately below it by means of standard construction techniques.

From an examination of FIG. 1, it is readily apparent that the openings between the parallel exterior and interior wall chords 30 and 31 provide roomy and ready passageways for electrical, plumbing, and heating/cooling ductwork. Similarly, the space between the top and bottom roof chords 14 and 15 permits considerable space for electrical, plumbing, and heating/cooling ductwork; so that it usually is not necessary to drill or cut holes through the 2"×4"s and other structural components to effect the installation of the electrical, plumbing and heating equipment in the building.

Reference should now be made to FIGS. 4 and 5 for some typical finished building treatments which may be accomplished by means of the building system using the trusses 10 illustrated in FIGS. 1 through 3.

FIG. 4 is a partially cut-away view of an interior wall used to illustrate different treatments which may be accomplished by means of the use of the trusses 10 in constructing a building. Each of the roof truss subassemblies have been shown in the open manner of FIG. 1 as extending outwardly over the room of which the wall shown in FIG. 1 is a part. The lower plane established by the bottom roof chords 15 then is covered with suitable ceiling material 100 in a conventional manner.

In most cases, it is desirable to have the exterior and interior chords 30 and 31 of the wall truss subsystems parallel to one another and vertically oriented when the truss 10 is in place. Typically, the distance between the outside edges of these wall chords is 2 feet. This is a standard closet depth and is an adequate depth for storage cabinets of various types including kitchen cabinets. Whenever one of the wall trusses 10 is located at a point in the building where it is exposed, it may be covered with a suitable wall covering 101, as shown for the leftmost truss 10 in FIG. 4.

The 2 foot depth between the inner and outer chords 30 and 31 of the wall truss subsystems permits the installation of both lower cabinets 102 and upper cabinets 103, as illustrated in FIG. 4. In addition, this depth provides different possibilities for placement of a window (in either a single or multi-section configurations). The 3-section window 105 of FIG. 4 is located on the inside wall portion of the truss system. The overhang produced then provides shade for the window 105, and the vertical extensions of the adjacent trusses (as shown in FIG. 4) provide additional shading or shielding from the sun wherever windows are placed on the south or west sides of a home in particular. It is not necessary, however, to confine the window treatment to the interior since the windows also may be placed on the outside wall, such as the double section window 106 shown on the right-hand end of the wall portion illustrated in FIG. 4. This then produces a shelf or a window seat (if located lower) to permit a wide variety of architectural treatments, depending upon the practical effects and the aesthetic effects desired.

Door openings, such as illustrated by the door 109, also may be set in from the exterior or placed on the exterior to frame the door. The door 109 also may be utilized as a closet section, and when the wall (such as shown in FIG. 4) is used in a bedroom, closet sections simply may be placed between each of the adjacent trusses 10 and incorporate an endless variety of built-in features limited only by the imagination of the designer utilizing the building system which is described.

FIG. 5 illustrates some exterior treatments which may be accomplished by the building system. For example, a window 114 (similar to the window 106 of FIG. 4) may be placed on the outside wall of the building. The roof treatment 115 (outlined by the heavy line in FIG. 5) may be set back in accordance with a variety of different treatments as illustrated, or it may extend along the outside edges of all of the trusses illustrated in FIG. 5. A typical arrangement utilizing an additional leg, such as the legs 83 or 84 of FIG. 3F, in shown in the patio treatment in the lower left-hand side of the building illustrated in FIG. 5. The outside legs of the trusses extend out over an open patio, and an interior leg 116 is used to form the interior wall of the building in which glass panels 117 are illustrated in FIG. 5. The treatment, however, is not limited to the illustrations shown in FIGS. 4 and 5, but may be as varied as the imagination of the builder or architect permits, ranging from a simple box-like structure to a complex design incorporating a variety of different features.

As is apparent from the foregoing, by constructing a building with prefabricated unitary roof/wall trusses, significant savings in both time and cost in the erection and completion of a building are possible. In addition, the thickness of the vertical or wall truss subsystems permits unique architectural treatments to be obtained.

It further should be noted that, if wider openings than the 32 inch openings which have been described are desired, conventional headers and the like may be employed with the wall truss subsystems cut out or cut short to accomodate such wider openings. To the extent possible, however, it is desirable to minimize such wider openings and to simply confine openings through the vertical wall sections of the building to the spaces between the trusses 10 as much as possible.

Various changes and modifications to the trusses and to the building system which has been disclosed above and which is shown in the drawings will occur to those skilled in the art. The preferred embodiment which has been described and shown is to be considered as illustrative only of the invention and not as limiting.

I claim:

1. A system for construction of a building having a floor and including, in combination:

a plurality of U-shaped truss members, each prefabricated as a single unitary member and each spaced a first predetermined distance from the next adjacent truss member and disposed in a parallel vertical planes normal to the floor of the building for providing primary structural support and unique architectural features for the building:

each truss member comprising (a) first and second wall truss subsystems, each comprising interior and exterior parallel wall chord members spaced apart a second predetermined distance and interconnected by a reinforcing web brace member, and (b) a roof truss subsystem having first and second ends and including top and bottom roof chord members, spaced apart and interconnected by a plurality of reinforcing web brace members, said first wall truss subsystem attached to said first end of said roof truss subsystem and said second wall truss subsystem attached to said second end of said roof truss subsystem to form each of said prefabricated unitary U-shaped truss members:

said second predetermined distance being substantially two feet to permit cabinets and closets of standard depth to be recessed in the spaces between adjacent ones of said U-shaped truss members;

means for maintaining said plurality of truss members in proper vertical orientation; and means for anchoring the bottom ends of said wall truss subsystem to the floor of the building.

2. The combination according to claim 1 wherein said top and bottom roof chord members and said interior and exterior wall chord members are made of standard 2″×4″ lumber.

3. The combination according to claim 1, further including a third wall truss subsystem comprising first and second parallel chord members spaced apart said second predetermined distance and interconnected by a reinforcing web brace member and attached to said roof truss subsystem between said first and second wall truss subsystems.

4. The combination according to claim 1 wherein said bottom roof chord member is parallel to the floor of the building.

5. The combination according to claim 1 wherein said top and bottom roof chord members are parallel to one another and are spaced a third predetermined distance apart.

6. The combination according to claim 1 wherein said reinforcing web member for said top and bottom roof chord members comprises a plurality of bracing webs extending between said top and bottom roof chord members; and said reinforcing web members for said interior and exterior wall chord members of said first and second wall truss subsystems each comprise a plurality bracing webs extending between said interior and exterior wall chord members of said first and second wall truss subsystems.

* * * * *